United States Patent [19]

Hickey

[11] 4,121,732

[45] Oct. 24, 1978

[54] CONTAINER HAVING SEAL MEANS

[75] Inventor: Christopher Daniel Dowling Hickey, Esher, England

[73] Assignee: Airflex Containers Limited, Ashford, England

[21] Appl. No.: 874,478

[22] Filed: Feb. 2, 1978

[30] Foreign Application Priority Data

May 2, 1977 [GB] United Kingdom ..... 18377/77

[51] Int. Cl.[2] ..... B65D 39/00; B65D 41/00; B65D 3/12

[52] U.S. Cl. ..... 220/232; 220/1.5; 206/597; 206/600

[58] Field of Search ..... 220/1.5, 232; 150/0.5; 206/497, 522, 597, 600

[56] References Cited

U.S. PATENT DOCUMENTS

| | | | |
|---|---|---|---|
| 3,221,921 | 12/1965 | Silverman | 220/232 |
| 3,850,214 | 11/1974 | Hickey | 150/0.5 |

*Primary Examiner*—George T. Hall
*Attorney, Agent, or Firm*—Young & Thompson

[57] ABSTRACT

In a container of the kind having an impermeable cover which is sealed to a base, air then being evacuated from the region between the cover and the base, an improved seal is provided for use with a rigid cover. The periphery of the cover fits into an endless groove or channel on the base, a temporary seal is then effected by inflating an endless tube or tubes in the groove and air is then evacuated from within the container so that the cover is drawn down onto an elastomeric strip in the base of the groove to effect a further seal which may hold even if pressure falls in the inflated tube or tubes.

10 Claims, 4 Drawing Figures

CONTAINER HAVING SEAL MEANS

BACKGROUND OF THE INVENTION

1. Field of the Invention

This invention relates to containers having a removable cover and from which the air can be at least partially evacuated.

2. Prior Art

For long-term storage of goods, it is known to form containers with a base, commonly rigid and which may be of pallet form, onto which base a cover may be sealed. Air is then evacuated from within the container. For many purposes, it is convenient to use a flexible impermeable cover such as is described for example in British Pat. No. 1,191,921. The periphery of the cover may be sealed into a groove or slot of a rigid impermeable base, the sealing being effected by means of an inflatable tube which may be integral with the cover or attached thereto or may be a separate tube located within the slot or groove as is described for example in U.S. Pat. No. 3,850,214. The tube, when inflated, presses the peripheral portion of the cover against one wall of the slot or groove.

It is the practice to use thick butyl rubber sheet to form such a flexible impermeable cover. When goods are stored for many years in such a container, it has proved necessary periodically to check the containers to ensure that there has been no leakage of air into the container. Such leakage might occur due to some very slight porosity in the flexible cover material or due to a slow leakage in the sealing arrangement.

SUMMARY OF THE INVENTION

It is one of the objects of the present invention to provide an improved form of container which is particularly advantageous for long-term storage of goods.

According to this invention, a container comprises a rigid impermeable base having an endless groove extending around an area of the base on which goods are to be placed, a rigid air-impermeable cover having a lower periphery shaped to fit in said groove, elastomeric material forming a seal on which the periphery of the cover rests, said groove containing an inflatable sealing tube extending along the whole length of the endless groove with means for inflating said tube to effect thereby a seal between the side wall of the groove and a peripheral portion of the cover surface around the whole periphery, and means for evacuating air from within the region between the cover and the base. The elastomeric material might be secured on the cover but more conveniently is located in the base of the groove.

With this form of container, goods to be stored are put on the base and the cover is then put over the goods with the periphery of the cover in the groove on the base. Since the cover is rigid, it is readily possible quickly to put the cover in the correct position located in the groove. The sealing tube is then inflated to form a first seal enabling air to be evacuated from within the cover. When air is evacuated from this region, the external air pressure loads the cover so pushing it firmly down onto the elastomeric strip at the base of the groove. This ensures that there is an airtight seal even if pressure is then released in the inflatable tube. The arrangement thus forms a container particularly suitable for long-term storage of goods. The cover may be made of metal or plastics material and it may be lined or partially lined with an air-impermeable material in order to provide further protection against any possibility of leakage of air into the container. For example if the cover is of metal and has welded joints, such welded joints might be covered by strips of impermeable flexible plastics material or rubber bonded to the metal to guard against any air leakage through porosity in the weld.

The means for evacuating air from the interior of the container may comprise a valve, for example a one-way valve in the cover or in the base; a portable air suction device may be connected to the valve when air is to be evacuated from the container. Preferably indicator means are provided for indicating the air pressure or vacuum within the container.

The inflatable tube producing the seal between the side wall of the groove and said peripheral portion of the cover surface is preferably housed within a resilient insert member which is detachably located in the groove, the tube and resilient member being arranged so that, when the tube is inflated, the tube protrudes from the resilient member to bear against the peripheral portion of the cover. Preferably this peripheral portion has a rib extending around the cover and located in a position such that the tube bears against the apex of the rib, thereby facilitating the obtaining of a tight seal.

A particular advantage of using a tube in a resilient insert is the possibility then of forming the insert with two separate tubes one above the other, each extending along the whole length of the endless groove. In this case the cover may be formed with two longitudinal ribs so that each tube bears against the apex of a separate rib on the cover so still further improving the sealing. The insert serves to hold two inflatable tubes spaced apart at the required location for separately sealing against the cover.

In a construction having a rigid cover, it is preferred that the base member should be substantially flat with the groove upstanding from the flat base. The cover thus comprises a top portion with downwardly-extending side portions. The base conveniently is formed as a pallet with slots for entry of prongs of a fork-lift truck. Preferably it has a flat undersurface for movement over ball or roller conveyors. Provision may be made for securing stacking posts on the base to enable containers to be stacked one on top of another.

DESCRIPTION OF THE PREFERRED EMBODIMENTS

Figure 1:
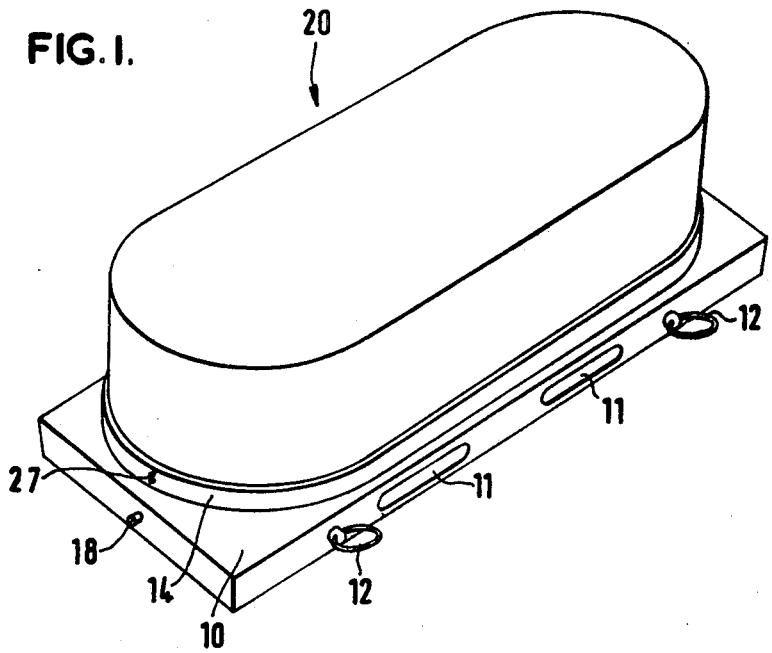
FIG. 1 is a perspective diagram illustrating the general construction of a container forming a first embodiment of the invention.
Figure 2:
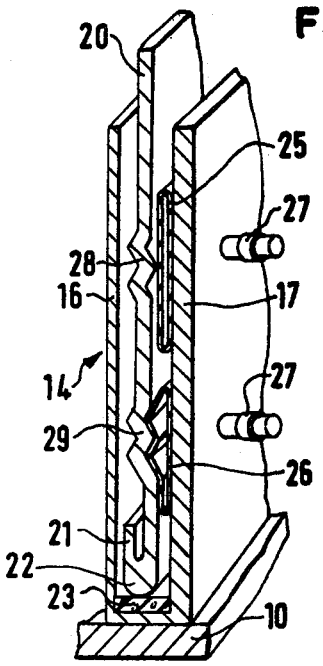
FIG. 2 is a sectional perspective diagram illustrating to a larger scale the sealing arrangement for sealing a cover in a channel on the base of the container of FIG. 1.

Referring to FIGS. 1 and 2, there is shown diagrammatically a container comprising a pallet-form base 10 having apertures 11 for entry of the prongs of a fork-lift truck and having shackles 12 for the attachment of chains for slinging the container. The pallet may be provided with stacking posts (not shown) for stacking one container on top of another. The undersurface of the container base 10 is preferably flat to facilitate movement over ball or roller conveyors. The pallet or at least the top surface thereof is formed of air-impermeable material and an endless channel 14 is provided which is upstanding from this upper surface of the pallet near the peripheral edge thereof. This channel is shown more clearly in FIG. 2 and has inner and outer side walls 16, 17 respectively. The container has a cover 20 (FIG. 1) of air-impermeable construction. In this embodiment, this cover is made of metal and it may be lined with impermeable rubber or plastics material bonded to the metal. Particularly if the cover is fabricated, e.g. by welding, lining may be required at least over the welds or other joints in order to ensure that the structure is airtight.

As shown in FIG. 2, the lower peripheral portion of the cover side is turned up at 21 to form a relatively blunt edge 22 which, when the cover is inserted between the walls of the channel sits on an elastomeric strip 23 extending along the bottom of the groove constituted by the channel. The strip may typically be formed of rubber or polymer and is an endless strip to form an airtight gasket. Around the outer wall 17 of the channel are two endless inflatable tubes 25, 26 each of which is provided with an inflation valve 27. In this particular embodiment, the two tubes are bonded to the side walls 17 so as to locate them one above the other along the length of the channel wall. The peripheral portion of the cover is shaped, where it lies adjacent these tubes, to provide longitudinal ridges 28, 29 so as to ensure that, when the tubes are inflated, as shown in FIG. 2 for the lower tube 26, a tight seal is provided between the tube and the cover 20.

To use the container, the goods are put on the base within the upstanding channel and the cover is then put over these goods, the edge of the cover extending down between the channel walls so that the cover seats on the aforementioned endless gasket. The tubes 25, 26 are inflated via their valves 27 to provide a temporary seal and then air is extracted from the interior of the container via a one-way valve 18 (FIG. 1) which, in this embodiment, is in the base of the container. As air is extracted, the external air pressure pushes the cover down tightly onto the gasket so effecting a secure and airtight seal to the edge of the cover. This forms a tight seal even if pressure is released from the sealing tubes 25, 26.

Figure 3:
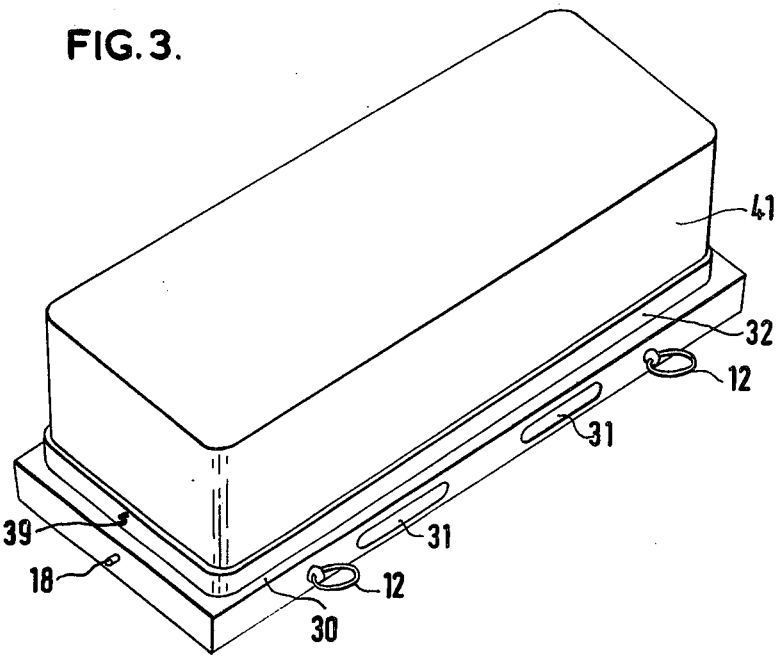
FIG. 3 is a perspective view illustrating the general arrangement of another form of container.
Figure 4:
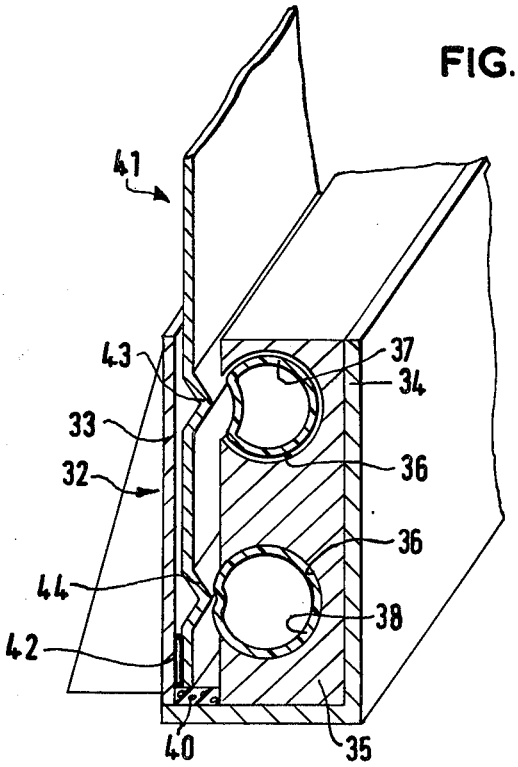
FIG. 4 is a sectional diagram illustrating a sealing arrangement used in the container of FIG. 3.

FIGS. 3 and 4 illustrate another embodiment of container again having a rigid pallet-form base 30 which is air-impermeable or at least covered with air-impermeable material. The pallet, as before, has a flat base for movement in a ball or roller conveyor and is provided with slots 31 for entry of the prongs of a fork-lift truck and may be provided with stacking posts. An endless channel 32 extends around the upper surface of the base near the outer periphery thereof this channel having inner and outer side walls 33, 34. In this channel is an endless insert 35 of elastomeric material for example a rubber or polymer containing two cavities 36 serving to retain inflatable tubes 37, 38. In FIG. 4 one of these tubes 37 is shown in the deflated condition and the other tube 38 in an inflated condition. Inflation valves 39 (FIG. 3) are provided extending through the outer wall 34 of the channel. The insert 35 extends only part of the way across the width of the channel 32. The remaining part of the channel at the bottom thereof contains a gasket formed by an elastomeric strip 40. The cover 41 of the container has a side wall which, at its lower end, has a turned-up portion 42 shown in FIG. 4 to provide a rounded portion which seats on the gasket 40 to seal thereto. Ribs 43, 44 are formed along the length of the peripheral portion of the cover to be adjacent the aforementioned inflatable tube.

The operation of the cover of FIGS. 3 and 4 is similar to that of FIGS. 1 and 2. It will be noted however that there is no need to bond the inflatable tubes 37, 38 to the channel wall. The insert 35 carrying these tubes serves to locate the tubes and may be removed from the channel 32 to facilitate the replacement of a tube if necessary. The insert 35, being resilient, ensures an airtight seal against the outer wall 34 of the channel. The tubes 37, 38 seal tightly against the ribbed portion of the cover 41 and hence, when these tubes are inflated, the cover is sealed to the base so as to enable air to be extracted from the container and thereby drawing the container cover down tightly onto the gasket 40 to give the primary seal.

I claim:

1. A container comprising a rigid impermeable base having an endless groove extending around an area of the base on which goods are to be placed, a rigid air-impermeable cover having a lower periphery shaped to fit in said groove, elastomeric material forming a seal between the base of the groove and the periphery of the cover, said groove furthermore containing an inflatable sealing tube extending along the whole length of the endless groove with means for inflating said tube to effect thereby a seal between the side wall of the groove and a peripheral portion of the cover surface around the whole periphery, and means for evacuating air from within the region between the cover and the base.

2. The container as claimed in claim 1 wherein the elastomeric material is arranged in the base of the groove.

3. A container as claimed in claim 1 wherein the cover is made of metal or plastics material and is lined or partially lined with air-impermeable material.

4. A container as claimed in claim 1 wherein a resilient insert is removably located in said groove, the inflatable tube producing the seal between the side wall of the groove and said peripheral portion of the cover surface being housed within said resilient insert member, the tube and resilient member being arranged so that, when the tube is inflated, the tube protrudes from the resilient member to bear against the peripheral portion of the cover.

5. A container as claimed in claim 1 wherein said peripheral portion of the cover has a rib extending around the cover and located in a position such that the tube bears against the apex of the rib.

6. A container as claimed in claim 4 wherein a second inflatable tube is housed in said resilient insert member, said second inflatable tube also being arranged so that, when it is inflated, it protrudes from the resilient insert member to bear against the peripheral portion of the cover, the two separate tubes being one above the other in the insert.

7. A container as claimed in claim 6 wherein the cover is formed with two longitudinal ribs so that each tube bears against the apex of a separate rib on the cover.

8. A container as clamed in claim 1 wherein the base member is substantially flat with the groove upstanding from the flat base.

9. A container as claimed in claim 1 wherein said base is formed as a pallet with slots for entry of prongs of a fork-lift truck.

10. A container as claimed in claim 9 wherein said base has a flat undersurface for movement over ball or roller conveyors.

* * * * *